US012037883B2

(12) United States Patent
Shetty et al.

(10) Patent No.: US 12,037,883 B2
(45) Date of Patent: Jul. 16, 2024

(54) REAL-TIME FRACTURE MONITORING, EVALUATION AND CONTROL

(71) Applicant: Halliburton Energy Services, Inc., Houston, TX (US)

(72) Inventors: Dinesh Ananda Shetty, Sugar Land, TX (US); Xusong Wang, Singapore (SG); Xiang Wu, Singapore (SG); Srividhya Sridhar, Bellaire, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 9 days.

(21) Appl. No.: 17/964,800

(22) Filed: Oct. 12, 2022

(65) Prior Publication Data

US 2023/0030531 A1 Feb. 2, 2023

Related U.S. Application Data

(62) Division of application No. 17/004,320, filed on Aug. 27, 2020, now Pat. No. 11,512,568.

(51) Int. Cl.

| | |
|---|---|
| ***E21B 49/00*** | (2006.01) |
| ***E21B 43/26*** | (2006.01) |
| ***E21B 47/06*** | (2012.01) |

(52) U.S. Cl.

CPC ..... *E21B 43/26* (2013.01); *E21B 47/06* (2013.01); *E21B 49/00* (2013.01); *E21B 2200/20* (2020.05)

(58) Field of Classification Search

CPC ..... E21B 47/06; E21B 49/00; E21B 2200/20; E21B 33/00

See application file for complete search history.

(56) References Cited

U.S. PATENT DOCUMENTS

| | | | | |
|---|---|---|---|---|
| 3,527,094 | A | 9/1970 | Yew et al. | |
| 5,190,378 | A | 3/1993 | Tanaka | |
| 8,274,399 | B2 * | 9/2012 | Strachan | G05B 13/048 340/870.02 |
| 8,794,316 | B2 | 8/2014 | Craig | |
| 9,249,654 | B2 * | 2/2016 | Strachan | E21B 44/00 |
| 9,297,250 | B2 | 3/2016 | Dusterhoft et al. | |
| 2009/0132169 | A1 | 5/2009 | Bordakov | |
| 2014/0262232 | A1 | 9/2014 | Glen et al. | |

(Continued)

OTHER PUBLICATIONS

Carey, M. A., Mondal, S., & Sharma, M. M. (2015). Analysis of Water Hammer Signatures for Fracture Diagnostics. SPE Annual Technical Conference and Exhibition. SPE-174866-MS.

(Continued)

*Primary Examiner* — Catherine Loikith

(74) *Attorney, Agent, or Firm* — Michael Jenney; C. Tumey Law Group PLLC

(57) ABSTRACT

Systems and methods generally relate to monitoring, evaluating, and controlling fracture geometry during a hydraulic fracturing operation, in real time. A method comprises measuring a signal representing a condition in a wellbore; inputting the signal into a model for estimating a dimension of a dominant fracture; determining the dimension of the dominant fracture; determining a target dimension for the dominant fracture; and minimizing a difference between the dimension of the dominant fracture and the target dimension in real time, by adjusting at least an injection pressure or flow rate of a hydraulic fracturing fluid into the wellbore.

20 Claims, 18 Drawing Sheets

(56) References Cited

U.S. PATENT DOCUMENTS

| | | | |
|---|---|---|---|
| 2015/0176394 | A1 | 6/2015 | Roussel et al. |
| 2016/0115780 | A1 | 4/2016 | James et al. |

OTHER PUBLICATIONS

Rahmani, A. R., & Shirdel, M. (2012). Impedance Analysis as a Tool for Hydraulic Fracture Diagnostics in Unconventional Reservoirs. SPE International Production and Operations Conference & Exhibition. SPE-156577-MS.

Wasantha, P. L. P., & Konietzky, H. (2017). Hydraulic Fracture Propagation under Varying In-situ Stress Conditions of Reservoirs. Procedia Engineering, 191, 410-418.

Canadian Examination report for Application No. 3096628 dated Dec. 7, 2021.

Office Action Summary for U.S. Appl. No. 17/004,320, filed Apr. 14, 2022.

Final Office Action Summary for U.S. Appl. No. 17/004,320, filed Jun. 20, 2022.

Notice of Allowance for U.S. Appl. No. 17/004,320, filed Aug. 5, 2022.

* cited by examiner

REAL-TIME FRACTURE MONITORING, EVALUATION AND CONTROL

CROSS REFERENCE TO RELATED APPLICATIONS

This application is a divisional of U.S. patent application Ser. No. 17/004,320, filed Aug. 27, 2020, which is incorporated by reference in its entirety.

BACKGROUND

Subterranean wells such as hydrocarbon wells, for example, may be stimulated by a hydraulic fracturing operation or fracking. During the fracking, a pressurized fluid is pumped into a wellbore at a pressure sufficient to create fractures propagating from the wellbore into a surrounding subterranean formation. Fracture monitoring and evaluation are critical real-time processes utilized during the fracking. These processes include monitoring and evaluating a structural change in the fractures (e.g., opening, closing, and growing), dimensions of fracture clusters, and/or a balance of fracture clusters, for example.

Fiber optic distributed acoustic sensor (DAS) technology is commonly used to monitor or evaluate a fracking result. DAS data may disclose a rock stress/strain which may be exerted by a slurry flow. The DAS data may also supply temporal and spatial information of rock stress/strain. However, only about 4% of wells include optical fiber cable installations, and most are installed in newer wells.

Another issue with the DAS is a detection of only a flow that passes through perforations. These perforations may cause acoustic interference due to cavitation noise. Thus, a development of a fracture cluster behind a perforation may be indirectly estimated from the flow through this perforation. Such estimates may require intensive training and application practice to interpret DAS data, accompanied with data from other sources.

BRIEF DESCRIPTION OF THE DRAWINGS

These drawings illustrate certain aspects of some examples of the present disclosure and should not be used to limit or define the disclosure.

DETAILED DESCRIPTION

Figure 1A:
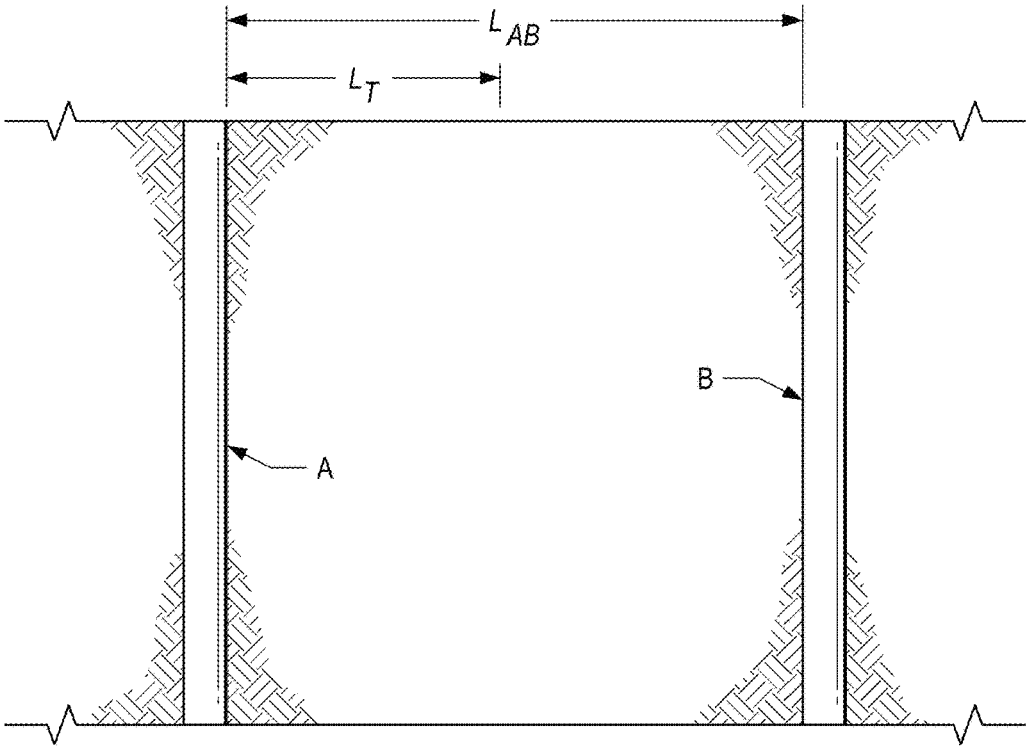
FIGS. 1A and 1B illustrate techniques for well interference control between a first wellbore and a second wellbore, in accordance with examples of the present disclosure.

Systems and methods of the present disclosure generally relate to systems and methods for real-time monitoring, evaluating, and controlling of fracture geometry during a hydraulic fracturing operation.

In some examples, the systems and the methods may estimate at least one dominant fracture dimension, such as a length of the dominant fracture ($L_d$). For example, a signal, such as a pressure, stress, or micro-seismic signal may be measured in the field, in real time, and may be inputted into an RLC model to estimate at least one dominant fracture dimension, such as the $L_d$. The RLC model is based on an RLC circuit that includes a resistor (R), an inductor (L), and a capacitor (C). An estimate for a dominant fracture dimension ($L_d$) and a target fracture length ($L_T$) may then be utilized to determine a difference between the $L_d$ and the $L_T$. This difference may be minimized by control actions such as adjustment of a hydraulic fracturing fluid flow rate into the wellbore and/or injection pressure of the hydraulic fracturing fluid, for example. Alternatively, a poro-elastic inversion may be utilized to estimate the dominant fracture dimension, such as the $L_d$. It should be noted that the above-mentioned techniques are non-limiting examples, and that other suitable techniques may be utilized to estimate the $L_d$ and the $L_T$, as should be apparent to one having skill in the art, with the benefit of this disclosure.

In particular examples, the systems and method of the present disclosure may also utilize a time varying RLC model which may describe a relation between a slurry rate and a borehole pressure during fracking. The techniques disclosed herein may also enable real-time monitoring and evaluation during a hydraulic fracturing operation in producing wells, which may improve a quality of the hydraulic fracturing services rendered.

For example, surface and/or downhole pressure data from a treatment well, which are available for many of wells, may be inputted into the RLC model for inversion to obtain fracture characteristics. For example, a fracture characteristic may include a fracture volume indicator which reveals a fracture propagation status in real time. The fracture volume indicator may also identify open or close times for fractures. With real-time information of the fracture propagation status, a field engineer may adjust operational fracking parameters (e.g., pumping rates) to control fracture clusters. There are also other operational indicators, such as net fracture pressure, slurry sagging rate, and borehole expansion rate which may collectively assist in guiding a fracking operation.

The fracture volume indicator may be obtained in real time from model parameters. Additional operational indicators such as slurry accumulation (sagging) rate, and borehole expansion rate may also be extracted via techniques disclosed herein. Also, the systems and methods may differentiate a pressure drop in and near a borehole, and a net fracture pressure drop. An algorithm may be utilized to calculate a power flow acting on a fracture to validate the techniques disclosed herein, by cross-checking a DAS average acoustic energy.

In some examples, a water hammer signal may be inverted to obtain the dominant fracture dimension. The dominant fracture dimension may be associated with the least resistant flow path. As noted above, a pressure signal may be inputted into the RLC model. The measured pressure signal may be high a frequency or low frequency measurement of an excitement of a hydraulic fracture system. The pressure signal(s) may be measured continuous or intermittently and may be utilized to solve the following system of Equations 1 and 2:

$$C\frac{\partial H}{\partial t}+\frac{\partial Q}{\partial x}=0 \tag{1}$$

$$L\frac{\partial Q}{\partial t}+\frac{\partial H}{\partial x}+RQ=0 \tag{2}$$

where Q is a pumping flow rate of hydraulic fracturing fluid into a wellbore; H is the hydraulic head, $$\frac{\partial H}{\partial t}$$

is time rate of change of hydraulic head;

$$\frac{\partial Q}{\partial x}$$

is a change in Q as a function of distance x;

$$\frac{\partial Q}{\partial t}$$

is a change in Q as a function of time t;

$$\frac{\partial H}{\partial x}$$

is change of hydraulic head as function of distance x. R, L, and C may be obtained from Equations (1) and (2) such that the measured pressure signal or response matches the response calculated by Equations 1 and 2. Once R, L, and C are determined, a geometry of a planar fracture may be obtained from Equations 3 to 7:

$$L_d=\sqrt{\frac{CL\Delta P}{\rho}} \tag{3}$$

$$h_f=\frac{4EXC}{\pi^2 L_f^2} \tag{4}$$

$$h_f=\sqrt{\frac{4EXC}{\pi^2 L_f}} \tag{5}$$

$$w=\frac{\rho L_f}{Lh_f} \tag{6}$$

$$\Delta P=\frac{4E}{\pi^2(1-\nu^2)}Xw \tag{7}$$

where ΔP is the pressure difference; ρ is density of the fluid; $h_f$ is fracture height; E is Young's Modulus; X is an elliptical integral of the second kind; $L_f$ is a length of a fracture; w is a width of the fracture; and ν is Poisson's ratio. Equation 4 may be used for shorter fractures where $2\ L_f/h_f<1$ and Equation 5 for other cases.

Alternatively, as noted above, a second technique for estimating the dominant fracture dimension (e.g., the $L_d$) inverts a poro-elastic response measured at an observation well. For example, most of a stress induced may be caused by the dominant fracture. The poro-elastic inversion may be formulated as:

$$L_d=f(\Delta p_{poro},P_{net},E,\nu,\ldots) \tag{8}$$

where $\Delta p_{poro}$ is poro-elastic pressure change; $P_{net}$ is a net fracture pressure; E is Young's Modulus; and ν is Poisson's ratio.

As noted above, alternate techniques that provide at least one dominant dimension (e.g., the $L_d$), such as, for example, techniques based on distributed acoustic sensing (DAS) flow rate measurements, stress, deformation or micro-seismic measurements, may be utilized. After determining the $L_d$, the $L_T$ (e.g., the target fracture length) may be determined to prevent well-interference, for example.

Figure 1B:
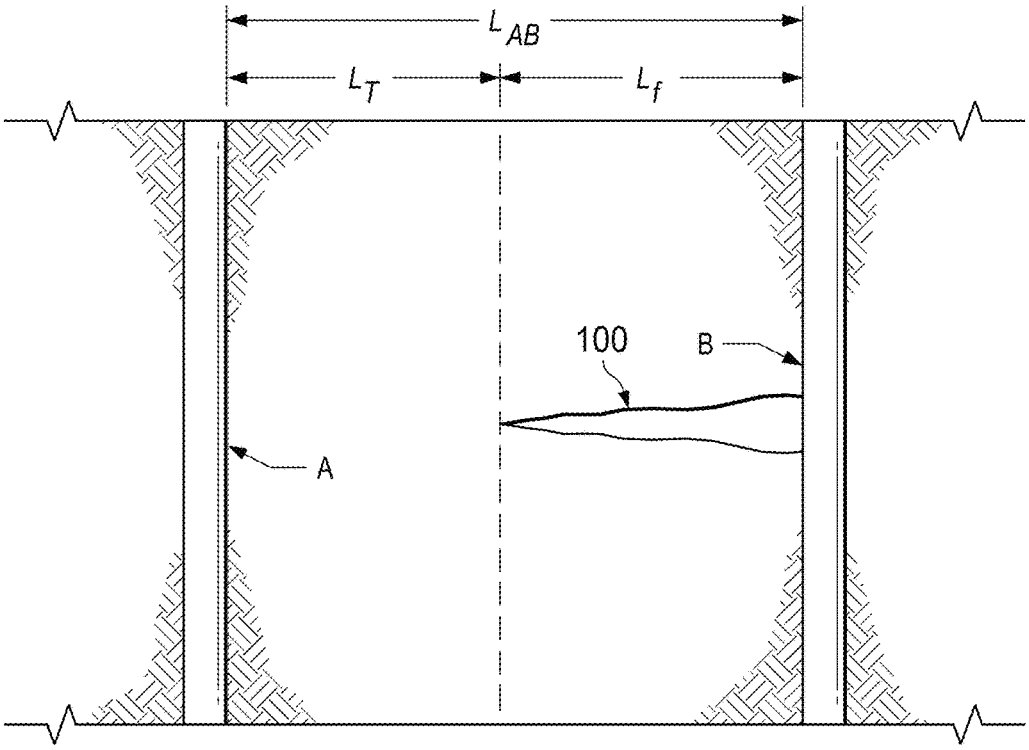

FIGS. 1A and 1B illustrate techniques for well interference control between a first wellbore A and a second wellbore B, in accordance with examples of the present disclosure. As illustrated on FIG. 1A, the target fracture length $L_T$ may be determined as follows:

$$L_T=L_{AB/2} \tag{9}$$

where a distance between the two wellbores is indicated by $L_{AB}$. The $L_T$ may be half of a distance between the two wellbores.

Alternatively, as illustrated on FIG. 1B, the target fracture length $L_T$ may be determined as follows:

$$L_T L_{AB}\text{-}L_f \tag{10}$$

where $L_f$ is a length of a fracture 100 propagating from the second wellbore B toward the first wellbore A. It should be noted that the well interference control scenarios, as illustrated in FIGS. 1A and 1B, are non-limiting examples. Other examples may include a distance to a depleted zone of a producing well, rather than a distance to a neighboring wellbore.

In some examples, a target dimension or the fracture length $L_T$ may be estimated with a theoretical estimate such as a Perkins-Kern-Nordgren (PKN) model or a Kristianovich-Geertsma-de Klerk (KGD) model. For example, the $L_T$ may be determined as follows:

$$L_T = 0.48\left[\frac{q^3 G}{(1-\nu)\mu}\right]^{1/6} t^{2/3} \tag{11}$$

$$q = \frac{Q}{nc} \tag{12}$$

where ν is Poisson's ratio; μ is hydraulic fracturing fluid viscosity; t is injection time; G is shear modulus of a formation; Q is a pumping flow rate of hydraulic fracturing fluid into a wellbore; nc is the number of clusters; and q represents a flowrate through each cluster. Each cluster may include a plurality of fractures.

In other examples, approaches to generate the target fracture length $L_T$ may be based on a machine learning a correlation based on measurements of past data as a function of time:

$$L_T(t) = f\left(Q, P, nc, cl, UI, \frac{SRV}{Q}, \ldots\right) \tag{13}$$

where UI is a uniformity index of a fracture; nc is the number of clusters; cl is a length of each cluster; Q is the pumping flow rate of the hydraulic fracturing fluid into the wellbore; t is time; and SRV is a stimulated reservoir volume.

Once this correlation function is developed, the $L_T$ for a flowing condition may be inferred. For example, to achieve UI=0.8, then the 0.8 value may be inputted into the above correlation along with other known inputs, to determine the $L_T$. In particular examples, a system controller may display differences, in real time, between the $L_T$ and the $L_d$. This allows adjustments to injection pressure and/or flow rate of a hydraulic fracturing fluid or slurry, to minimize these differences.

Figure 2A:
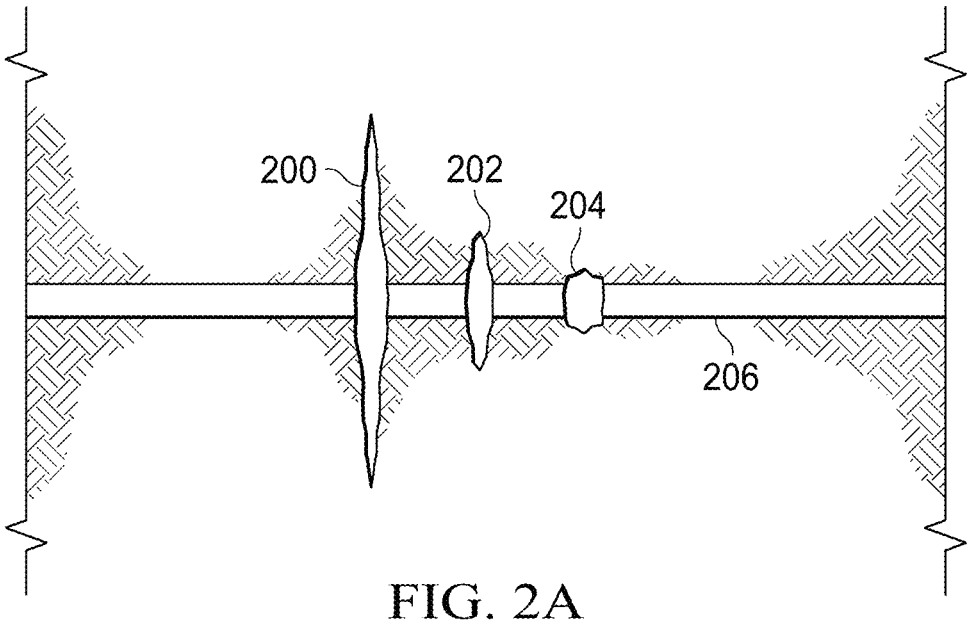
FIGS. 2A-2F illustrate achieving equal fracture dimensions in real time, during a hydraulic fracturing operation, in accordance with examples of the present disclosure.
Figure 2B:
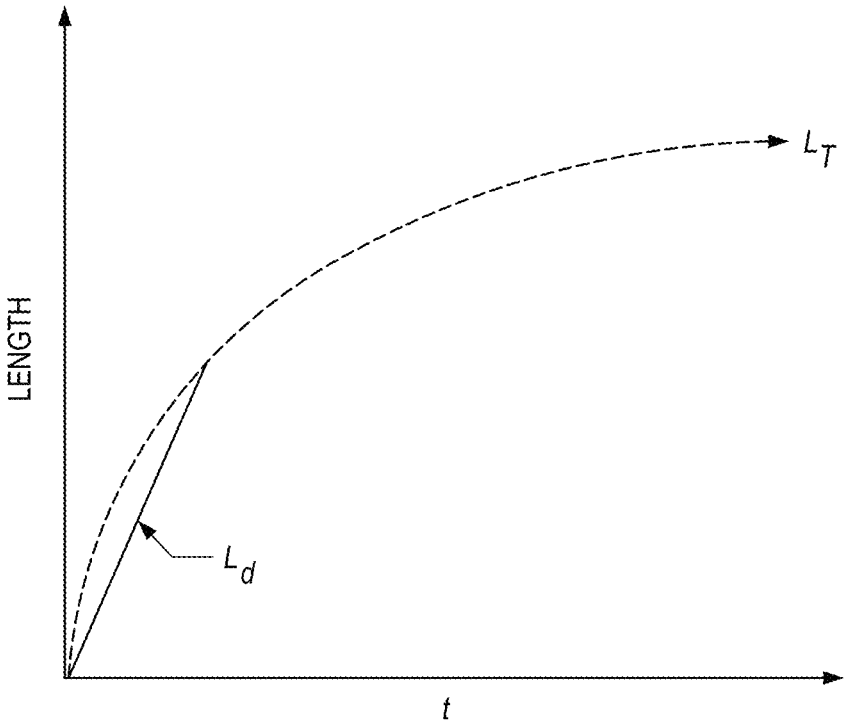

FIGS. 2A-2F illustrate achieving equal fracture dimensions in real time, during a hydraulic fracturing operation, in accordance with examples of the present disclosure. As shown on FIG. 2A, a primary or dominant fracture 200 and non-dominant or secondary fractures 202 and 204 may propagate from a wellbore 206. FIG. 2B illustrates a length $L_d$ of the dominant fracture 200 of FIG. 2A and the target length $L_T$ for the dominant fracture 200 in real time t.

Figure 2C:
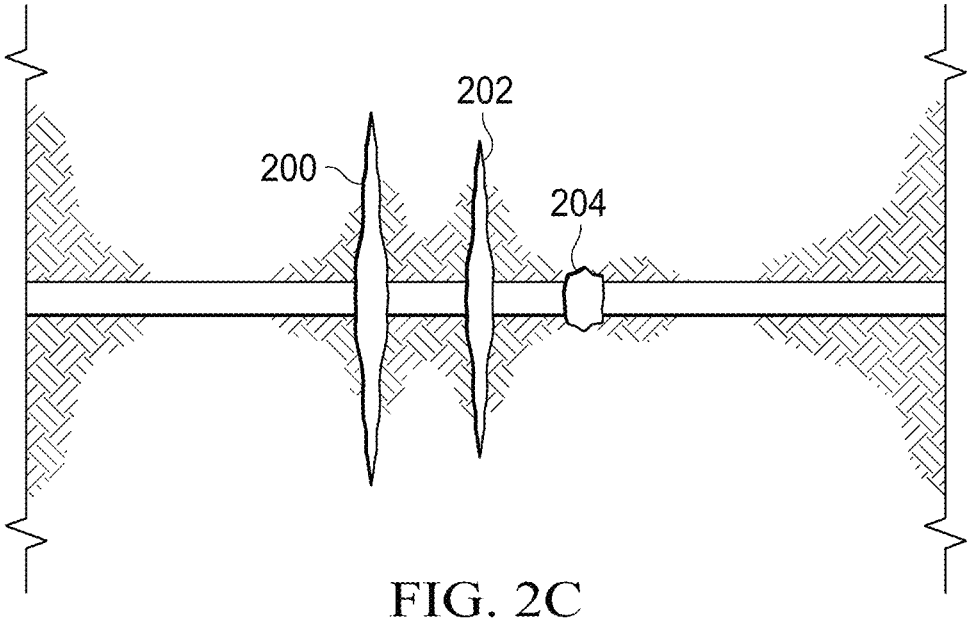
Figure 2D:
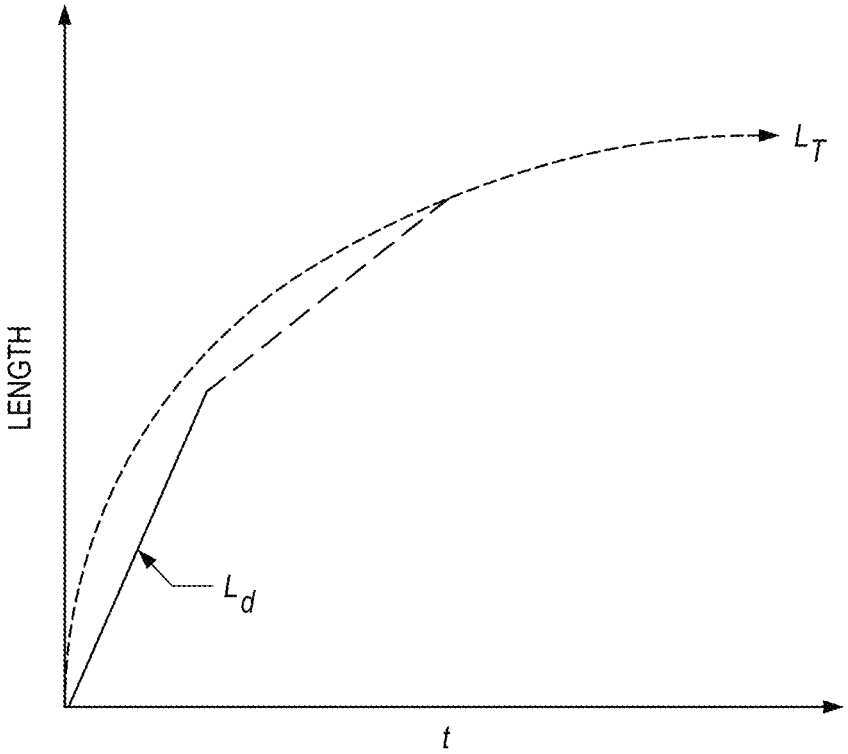

FIG. 2C illustrates controlling the dominant fracture 200 such that the non-dominant fracture 202 increases to a length slightly less than the dominant fracture 200. The non-dominant fracture 204 may be unchanged. Control of the dominant fracture 200 may lead to different and/or increased growth rates in the non-dominant fractures 202 and 204, due to mass conservation. FIG. 2D illustrates a difference between the length $L_d$ of the dominant fracture 200 and the target length $L_T$ for the dominant fracture 200 of FIG. 2C, as the t increases. The difference between the length $L_d$ and the target length $L_T$ decreases as the t increases.

Figure 2E:
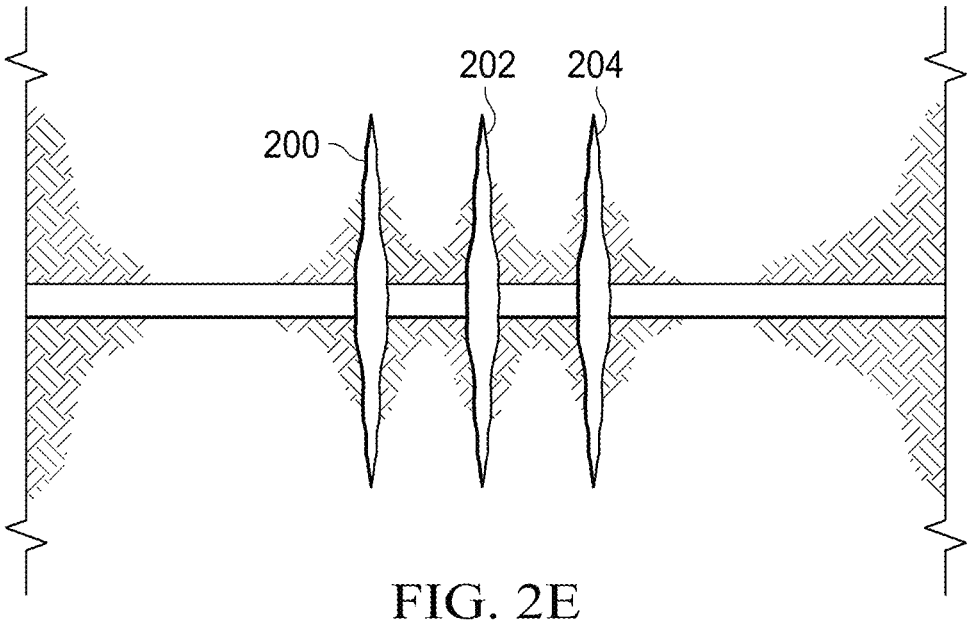
Figure 2F:
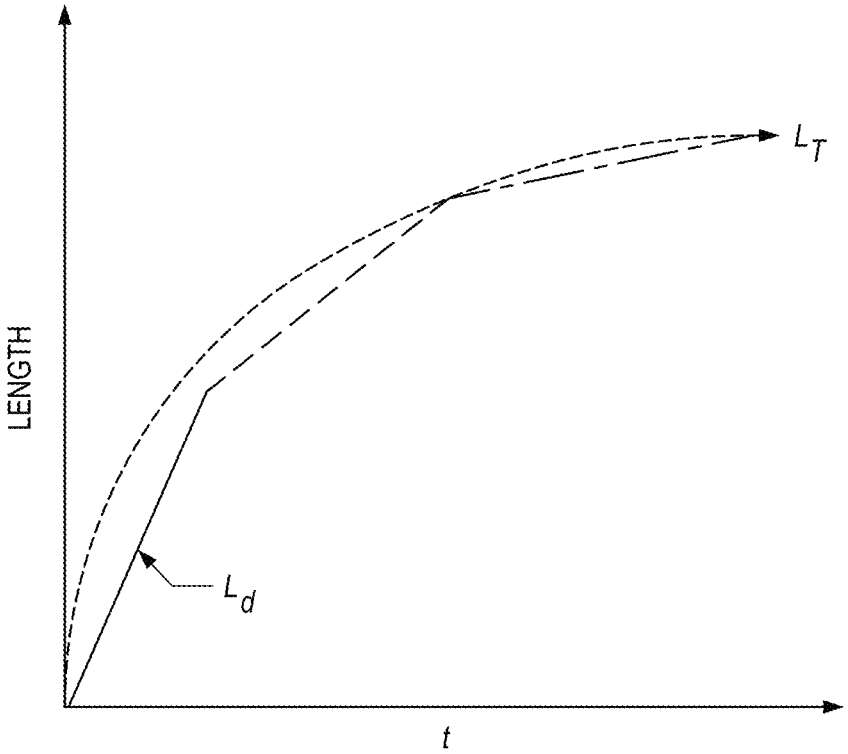

FIG. 2E illustrates controlling the dominant fracture 200 such that the dominant fracture 200 and the non-dominant fractures 202 and 204 achieve equivalent geometry. As shown on FIG. 2F, a difference between the length $L_d$ of the dominant fracture 200 and the target length $L_T$ for the dominant fracture 200 may be controlled in real time t such that all of the fractures achieve equal geometry. Real time controlling of the fractures may occur with adjustment of pumping rates and/or pressures until desired fracture geometries are achieved. Controlling may include preventing, maintaining, reducing, or increasing propagation of at least one fracture.

Figure 3:
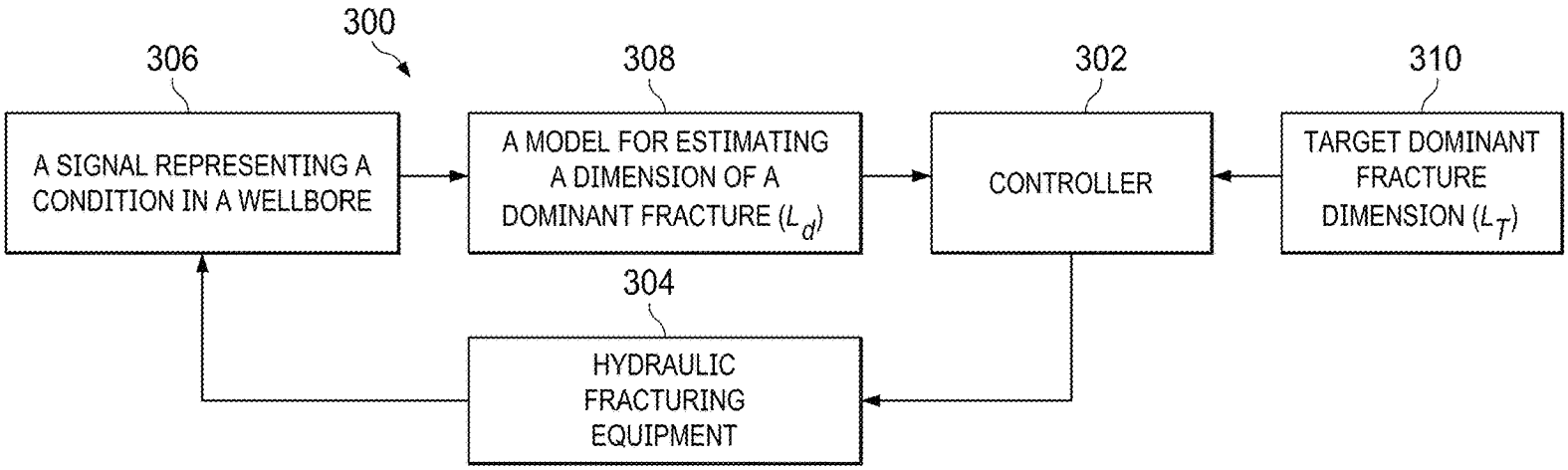
FIG. 3 illustrates a schematic diagram of a system 300 for controlling fracture geometry during a hydraulic fracturing operation, in accordance with examples of the present disclosure.

FIG. 3 illustrates a schematic diagram of a system 300 for controlling fracture geometry during a hydraulic fracturing operation, in accordance with examples of the present disclosure. A system controller 302 may be in communication with hydraulic fracturing equipment 304 (e.g., pumps, sensors, conduits, hydraulic fracturing fluid). A signal or response 306 resulting from injection of a hydraulic fracturing fluid into a wellbore, may be measured and inputted into a mathematical model 308 (e.g., RLC model) for estimating a dimension of a dominant fracture (e.g., $L_d$). The system controller 302 may calculate the $L_d$ via the model 308. The $L_T$ may be calculated by the system controller 302 or inputted into the system controller 302 as an input 310. The input 310 may include a variety of inputs such as the $L_T$.

The system controller 302 may direct the hydraulic fracturing equipment 304 to adjust a pumping pressure or rate to minimize a difference between the $L_d$ and the $L_T$. The system controller 302 may include a programmable logic controller ("PLC"), for example. In other examples, the system controller 302 may include may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. The system controller 302 may be any processor-driven device, such as, but not limited to, a personal computer, laptop computer, smartphone, tablet, handheld computer, dedicated processing device, and/or an array of computing devices. In addition to having a processor, the system controller 302 may include a server, a memory, input/output ("I/O") interface(s), and a network interface. The memory may be any computer-readable medium, coupled to the processor, such as RAM, ROM, and/or a removable storage device for storing data and a database management system ("DBMS") to facilitate management of data stored in memory and/or stored in separate databases. The system controller 302 may also include display devices such as a monitor featuring an operating system, media browser, and the ability to operate one or more software applications. Additionally, the system controller 302 may include non-transitory computer-readable media. Non-transitory computer-readable media may include any instrumentality or aggregation of instrumentalities that may retain data and/or instructions for a period of time.

Figure 4:
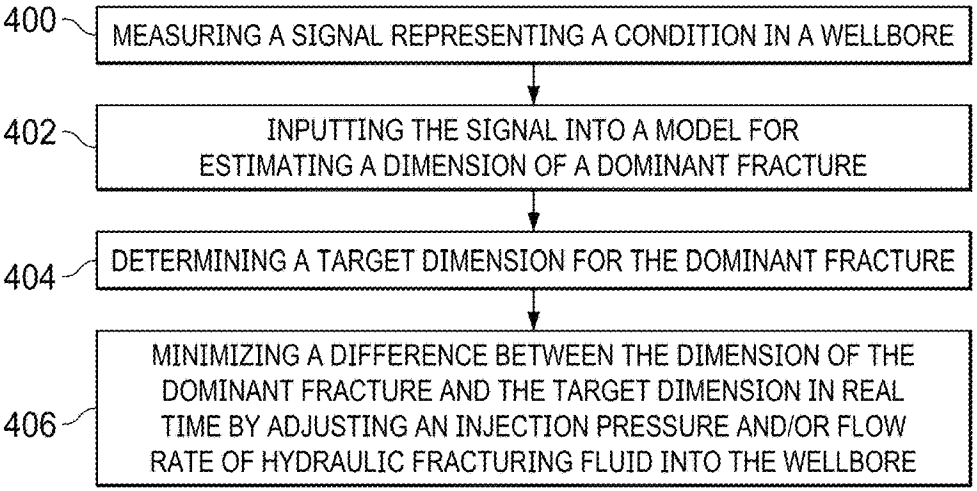
FIG. 4 illustrates a flow chart for controlling fracture geometry during a hydraulic fracturing operation, in accordance with examples of the present disclosure.

FIG. 4 illustrates a flow chart for controlling fracture geometry during a hydraulic fracturing operation, in accordance with examples of the present disclosure. At step 400, a signal representing a condition in a wellbore is measured. The signal may include pressure measurements, flow rate measurements, stress measurements, deformation measurements, and/or micro-seismic measurements. At step 402, the signal may be inputted into a mathematical model (e.g., the RLC model) for estimating a dimension of a dominant fracture (e.g., $L_d$). At step 404, a target dimension for the dominant fracture (e.g., $L_T$) may be determined. At step 406, a difference between the $L_d$ and the $L_T$ may be minimized by adjusting an injection pressure and/or flow rate of a hydraulic fracturing fluid into the wellbore.

Figure 5:
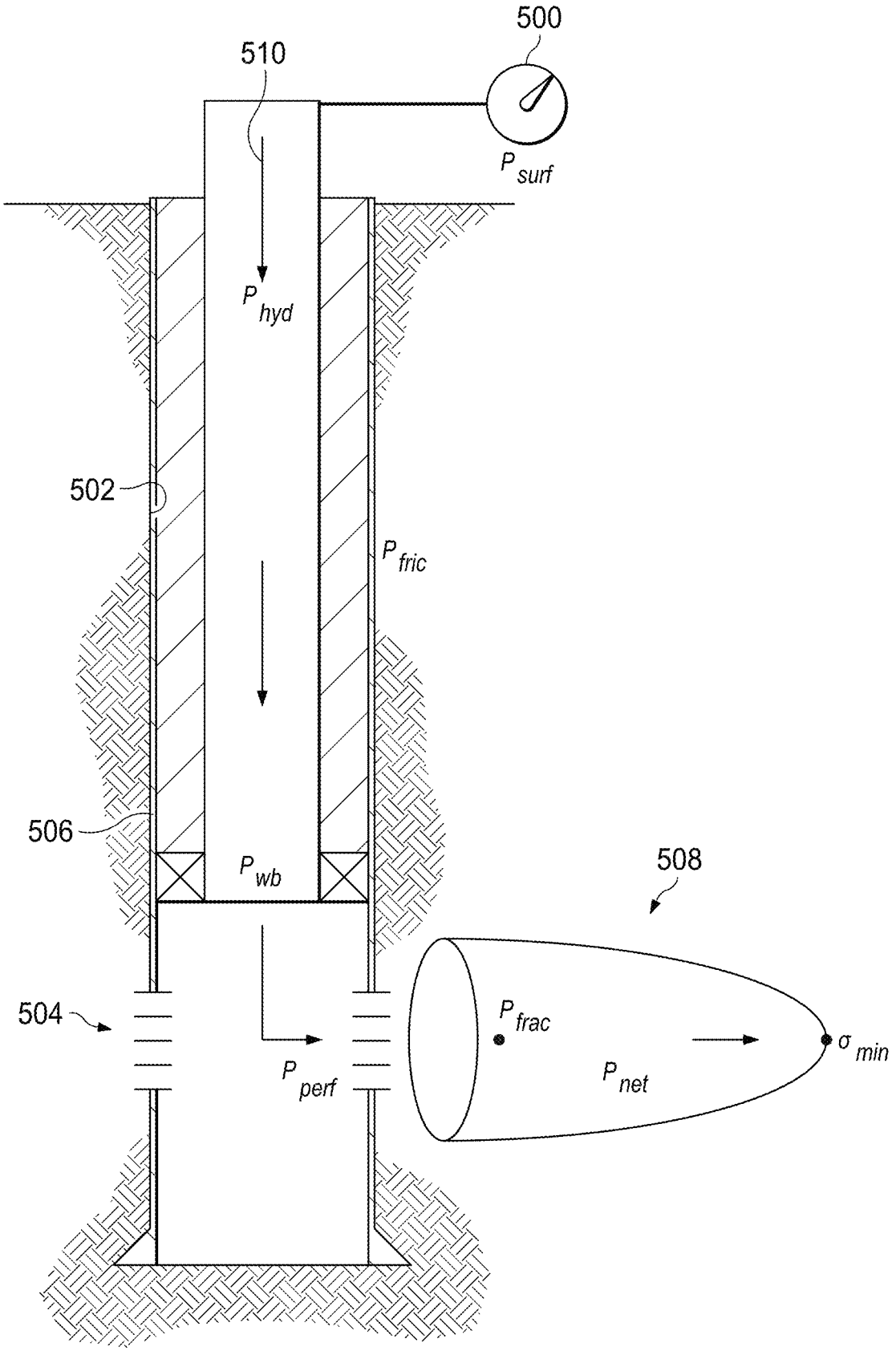
FIG. 5 illustrates various pressures that may be utilized to control a fracking operation, in accordance with examples of the present disclosure.

FIG. 5 illustrates various pressures that may be utilized to control a fracking operation, in accordance with examples of the present disclosure. As illustrated, $P_{surf}$ is a surface pressure that may be measured with a sensor or gauge 500. $P_{hyd}$ is a hydrostatic pressure within a wellbore 502. $P_{BH}$ or $P_{wb}$ is a bottom hole or well bottom pressure of the wellbore 502. $P_{fric}$ is a friction pressure in the wellbore 502. $P_{perf}$ is a perforation pressure at perforations 504 of casing 506 that is disposed within the wellbore 502. $P_{tort}$ is tortuosity pressure within the wellbore 502. $P_{frac}$ is a fracture pressure. $P_{net}$ is a net fracture pressure. $P_{close}=\sigma_{min}$ (minimum stress) which is a fracture close pressure for a fracture 508. A flow of fracking fluid is indicated with directional arrows 510. A relationship between different pressures may be expressed by the following system of equations:

$$P_{BH}=P_{surf}+P_{hyd}-P_{fric} \tag{14}$$

$$P_{BH}=P_{perf}+P_{tort}+P_{frac} \tag{15}$$

$$P_{frac}=P_{net}+P_{close} \tag{16}$$

Equations 14 to 16 utilize the $P_{BH}$ as a pressure input, however, if the $P_{BH}$ is not available, the $P_{surf}$ may be used as the pressure input.

The net fracture pressure $P_{net}$ may directly act on reservoir rock pore space to expand a fracture volume, however, the $P_{net}$ may be difficult to measure directly. If a slurry rate is constant, $P_{fric}$ $P_{perf}$ $P_{tort}$ may remain unchanged, if assuming the close pressure P close is also unchanged. Thus, the borehole pressure change $P_{BH}$ may correspond with the net fracture pressure $P_{net}$, if the slurry rate is constant. In some examples, the friction pressure $P_{fric}$ may change dramatically, hence the borehole pressure $P_{BH}$ may be a combined result of the friction pressure $P_{fric}$ and the net fracture pressure $P_{net}$. In other examples, a borehole pressure change may be dominated by a friction pressure change. The actual net fracture pressure change may be overwhelmed by the friction pressure change. Thus, particular examples utilize a slurry mass flow RLC model to characterize fracture propagation during fracking.

Figure 6:
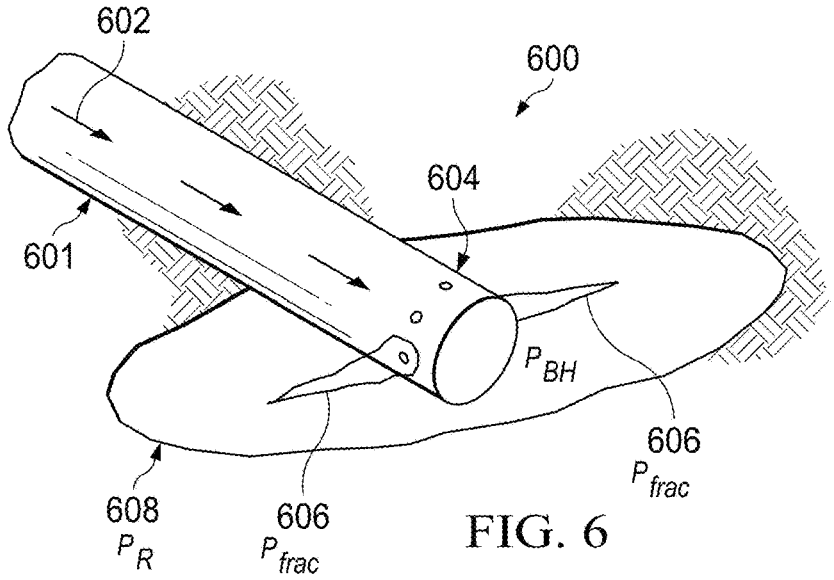
FIG. 6 illustrates a hydraulic system including a horizontal wellbore during a fracking operation, in accordance with examples of the present disclosure.

FIG. 6 illustrates a hydraulic system 600 including a horizontal wellbore 601 during a fracking operation, in accordance with examples of the present disclosure. A fracking fluid such as a slurry is injected into the wellbore 601. This slurry mass flow (or flow rate) is indicated with directional arrows 602. The slurry may accumulate at a bottom 604 of the wellbore 601 and may also accumulate in existing fractures 606 in the borehole 601. A pressure of a reservoir 608 is indicated with $P_R$. A fracture pressure of each fracture 606 is indicated with $P_{frac}$.

Figure 7:
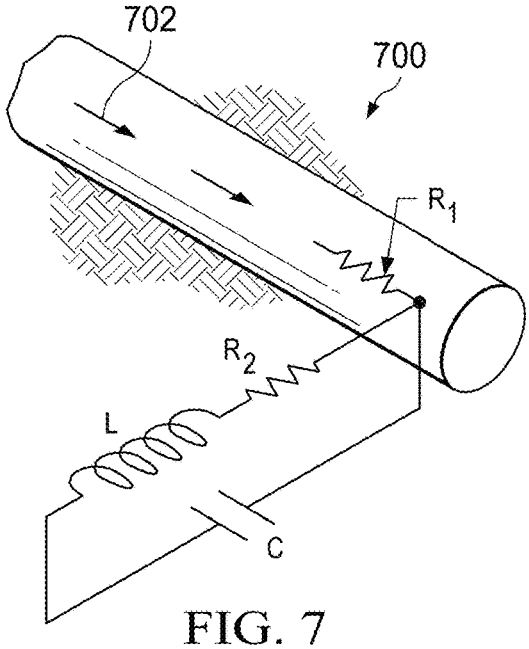
FIG. 7 illustrates an equivalent electrical circuit that may represent the hydraulic system of FIG. 6, in accordance with examples of the present disclosure.

FIG. 7 illustrates an equivalent or corresponding electrical circuit 700 that represents the hydraulic system 600 of FIG. 6, in accordance with examples of the present disclosure. A flow of electrical current is indicated with directional arrows 702 that correspond to the slurry mass flow of FIG. 6, for example. $R_1$ and $R_2$ are resistors. A capacitor C and inductor L are also illustrated. The circuit 700 may correspond to a fracture 606 of FIG. 6. As illustrated, the electrical current (i.e., an equivalent to the slurry of FIG. 6) may be stored in the capacitor C, or pass through the resistors $R_1$ and $R_2$ and inductor L. Components of the circuit 700 are connected in parallel, rather than in series. For example, in contrast to FIG. 7, a water hammer model may be represented as an RLC circuit with components in series.

Figure 8:
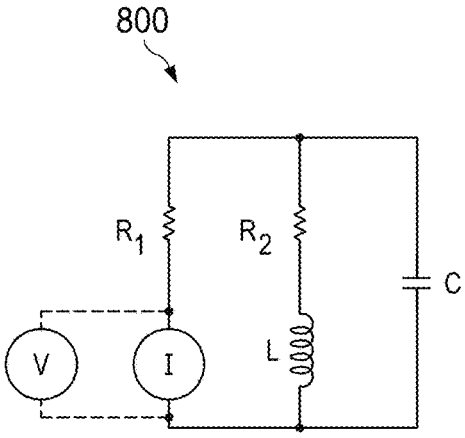
FIG. 8 illustrates an equivalent parallel circuit that may represent the hydraulic system of FIG. 6, in accordance with examples of the present disclosure.

FIG. 8 illustrates an equivalent parallel circuit 800 that may also represent the hydraulic system 600 of FIG. 6, in accordance with examples of the present disclosure. The circuit 800 represents the slurry moving inside a borehole, fracture, and reservoir, and a resultant reservoir pressure change. The capacitor is represented by C and the inductor is represented by L. $R_1$ is the friction pressure and close pressure related resistance. A complex impedance frequency response of $R_1$ may be a full bandwidth constant value in a frequency domain. $R_2$ is a net fracture pressure related resistance. $R_2$ may be an accumulative response of the slurry rate. Thus mathematically, the accumulation or integral effects may act as a low-pass filter (or a high-pass filter if the net fracture pressure is releasing due to an open fracture or propagation), which may be delineated by $R_2$, L, and C in the analog electrical circuit 800. A current I represents the slurry flow rate. A voltage V represents a measured pressure.

Figure 9:
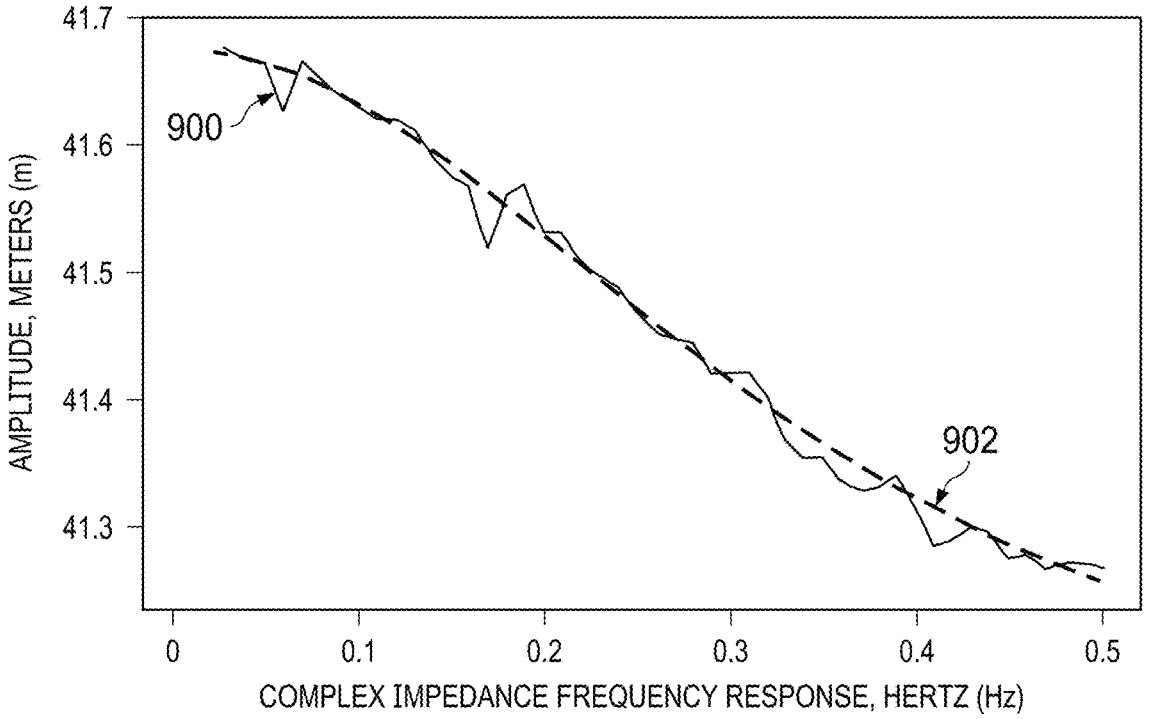
FIG. 9 illustrates an inversion result of a mass flow model based on resistance, inductance, and capacitance (RLC), in accordance with examples of the present disclosure.

FIG. 9 illustrates an inversion result 900 of a mass flow RLC model, in accordance with examples of the present disclosure. A complex impedance frequency response is shown within a window. A curve 902 is fitted to the inversion result 900. Fitting parameters may include $R_1$, $R_2$, C, and L.

Figure 10:
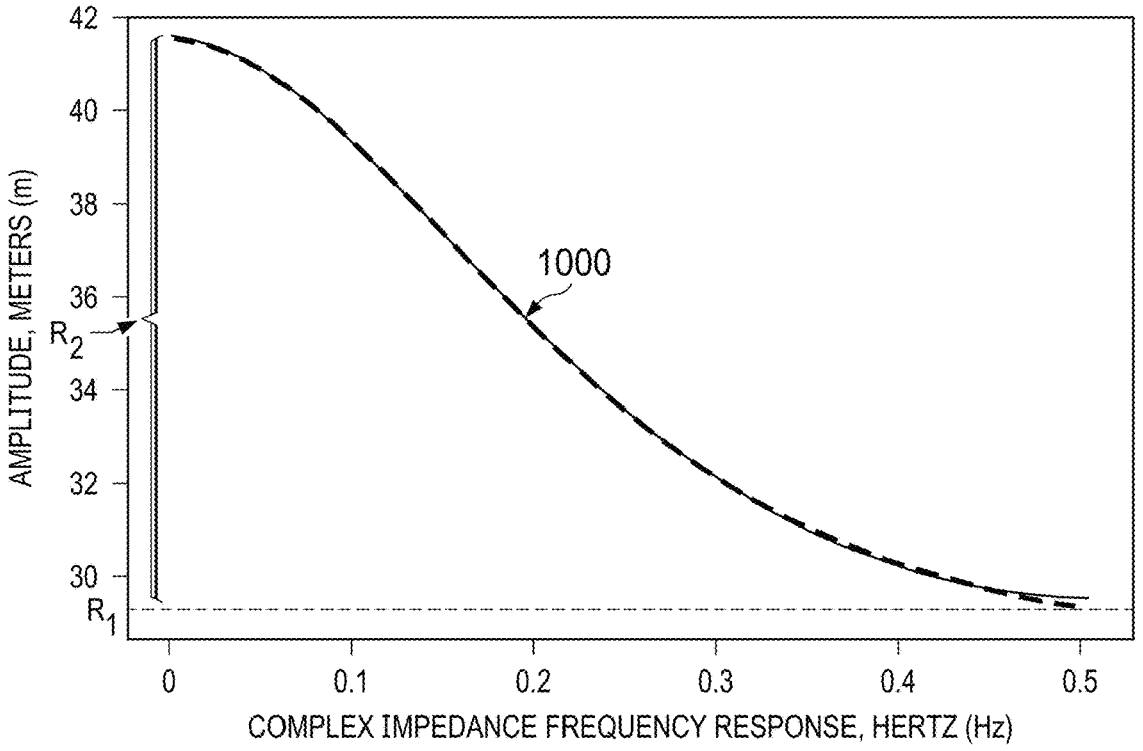
FIG. 10 illustrates a mass flow RLC model transfer function Fast Fourier Transform frequency response simulation and a fitting model, in accordance with examples of the present disclosure.

FIG. 10 illustrates a mass flow RLC model transfer function FFT frequency response simulation and its fitting model, in accordance with examples of the present disclosure. FFT is Fast Fourier Transform. $R_1$ is a horizontal straight line since it is a frequency independent parameter. $R_2$ is frequency dependent resistance whose amplitude decay curve 1000 in a frequency domain, may be determined by L and C. The mass flow RLC model utilizes different characteristics of friction pressures and net fracture pressures in the FFT frequency domain. $R_2$ is frequency dependent and $R_1$ is frequency independent. Based on the different frequency responses, the mass flow RLC model may separate the net fracture pressure from a total bottom hole heel pressure and may infer fracture propagation or operational indicators. By inverting this mass flow RLC model through a moving window, the operational indicators inferred from inversion results may include: a net fracture pressure drop ($P_2$) and a borehole, near borehole, and close-pressure drop ($P_1$); a power-flow acting on a fracture (power); a fracture volume ($V_{fracture}$) or its indicator; a fracture volume expansion speed ($\delta$); a slurry accumulation ratio ($\lambda$); a slurry density indicator ($R_2$); a borehole slurry mass indicator (L). For example, the fracture volume indicator ($V_{fracture}$) indicates instantaneous progress of a fracture propagation (i.e., expanding or shrinking); and fracture volume expansion rate ($\delta$) indicates a dynamic fracture status (i.e., open or close). The slurry density indicator ($R_2$) and the slurry mass indicator (L) may indicate a condition of a wellbore (e.g., a slurry mass accumulating and slurry density change), or may be used for geo-hazard prevention during fracking.

Figure 11:
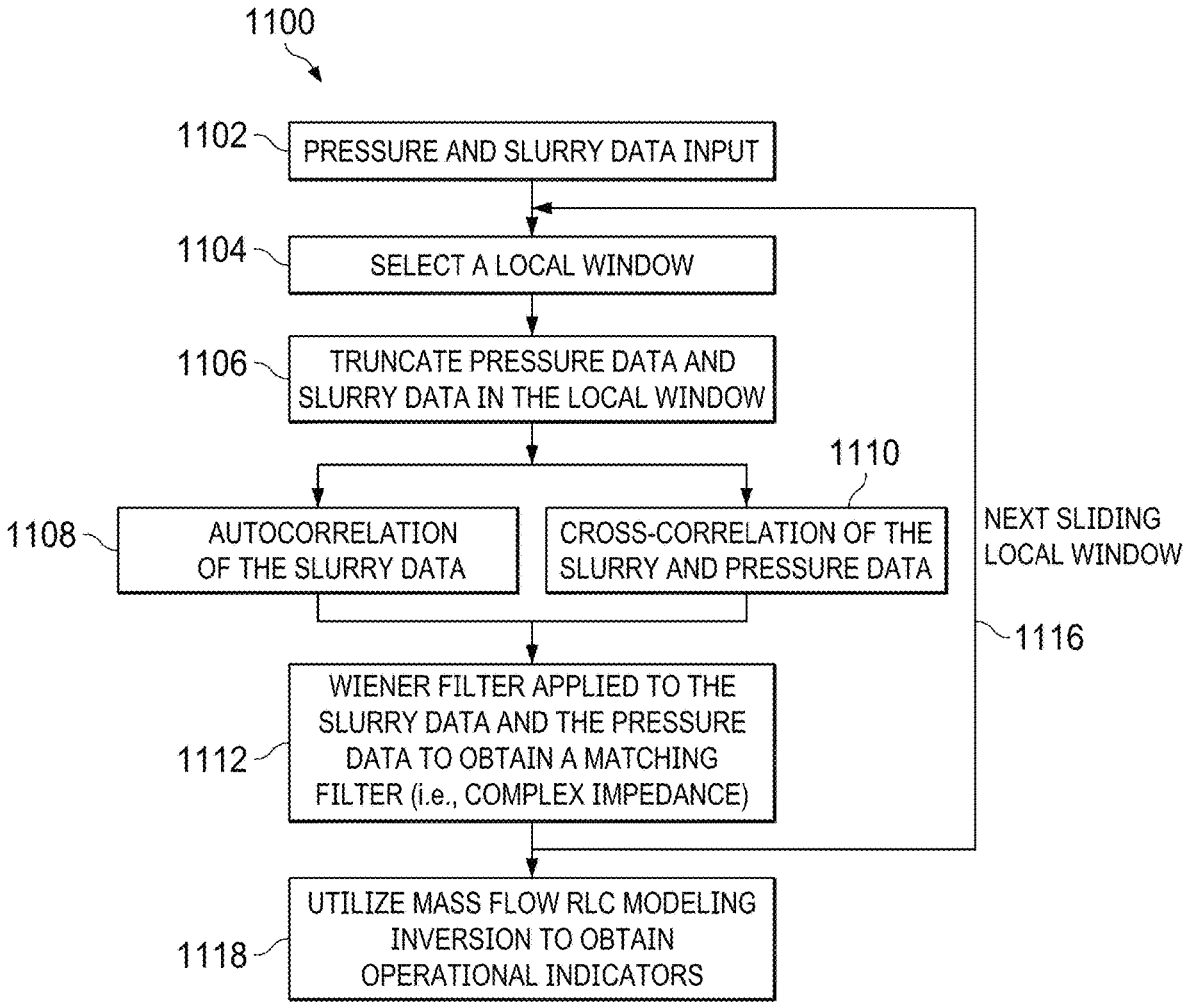
FIG. 11 illustrates a workflow for monitoring and evaluating subterranean fractures during a hydraulic fracturing operation, in accordance with examples of the present disclosure.

FIG. 11 illustrates a workflow 1100 for monitoring and evaluating subterranean fractures during a hydraulic fracturing operation, in accordance with examples of the present disclosure. At block 1102, pressure data (e.g. heel pressure) and slurry data (e.g., flow rate) are inputted into a mass flow RLC model. At block 1104, a cascading sliding local window is selected. At block 1106, the pressure and slurry data are truncated in the local window. At block 1108, the slurry data is autocorrelated. At block 1110, the slurry data is cross-correlated with the pressure data. At block 1112, a filter may be applied to the slurry data and the pressure data to obtain a matching filter (i.e., complex impedance). A non-limiting example of a filter is a Wiener filter. It should be noted that other filters may be utilized to obtain the matching filter, as should be understood by one having skill in the art, with the benefit of this disclosure. Then, a new sliding local window may be selected and blocks 1104 to 1112 may be repeated, as indicated by directional arrow 1116. At block 1118, the mass flow RLC model parameters are inverted to obtain the operational indicators, as noted above.

Figure 12:
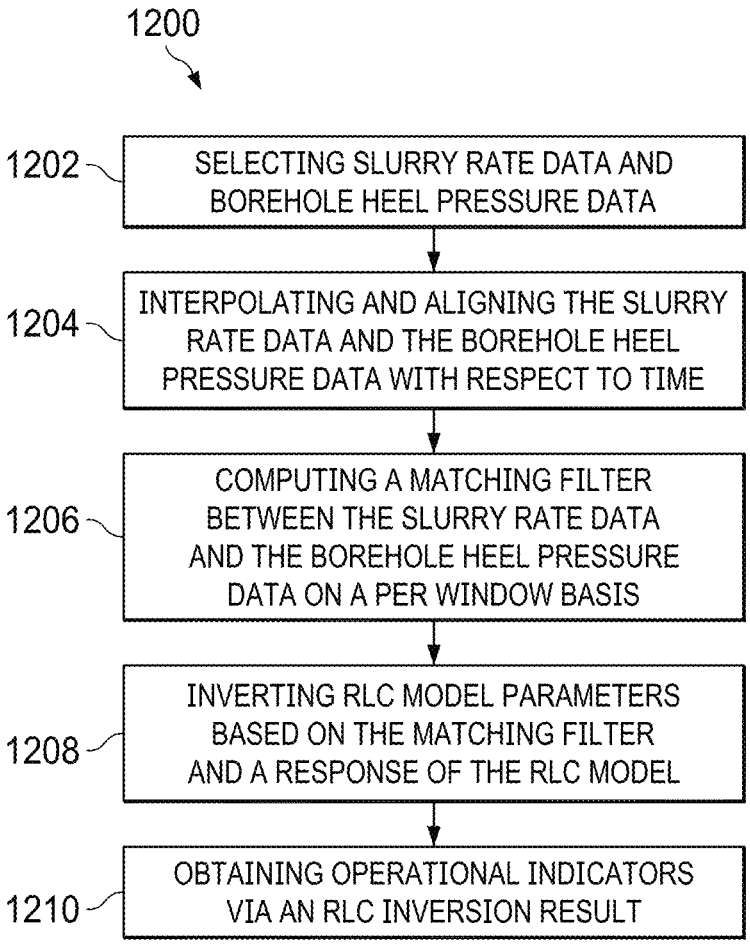
FIG. 12 illustrates another workflow for monitoring and evaluating subterranean fractures during a hydraulic fracturing operation, in accordance with examples of the present disclosure.

FIG. 12 illustrates a workflow 1200 for monitoring and evaluating subterranean fractures during a hydraulic fracturing operation, in accordance with examples of the present disclosure. At step 1202, slurry rate data and borehole heel pressure data are selected. At step 1204, the slurry rate data and the borehole heel pressure data are interpolated and aligned with respect to time. At step 1206, a matching filter between the slurry rate data and the borehole heel pressure data are computed for a selected window (e.g., on a per window basis). At step 1208, RLC model parameters are inverted based on the matching filter and a response of the RLC model. At step 1210, the operational indicators are obtained through the RLC inversion response or result. It should be noted that a proppant data correction may be applied by calibrating an input pressure by deducting effects of the proppant. This data correction may provide for an improved match with DAS acoustic data.

Figure 13A:
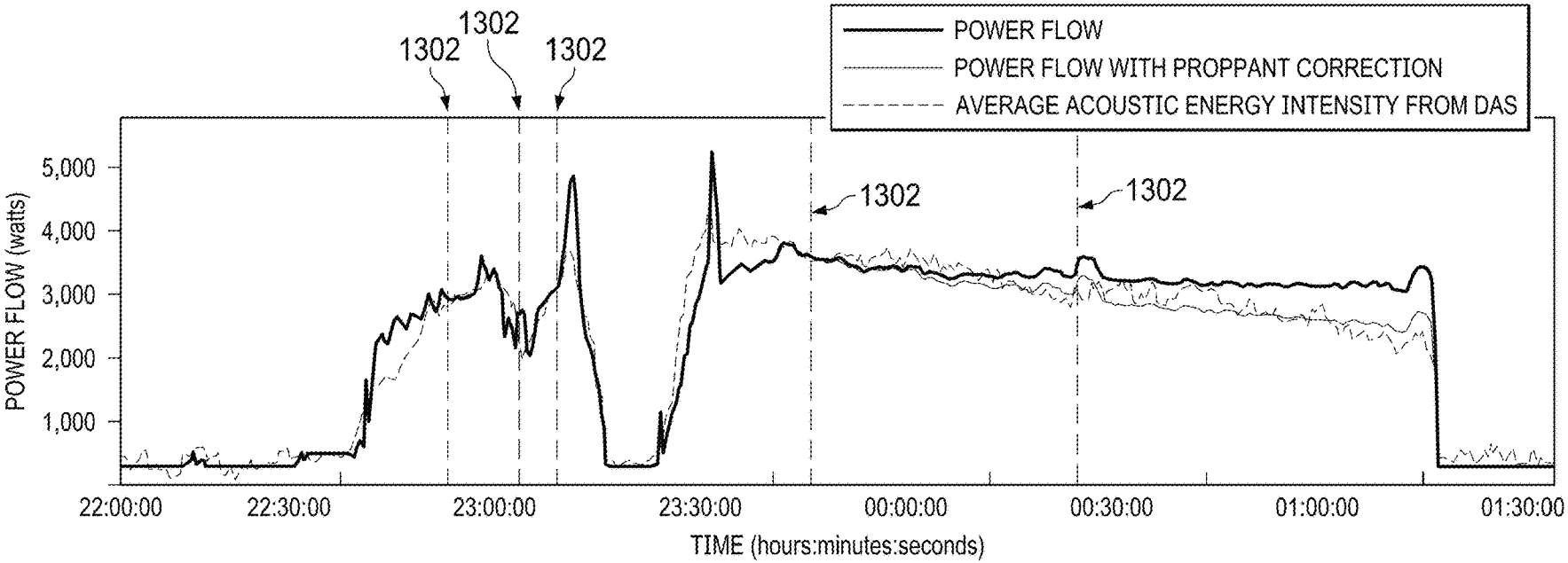
FIGS. 13A and 13B illustrate a power flow of the RLC inversion response compared with averaged DAS acoustic energy intensity, in accordance with examples of the present disclosure.
Figure 13B:
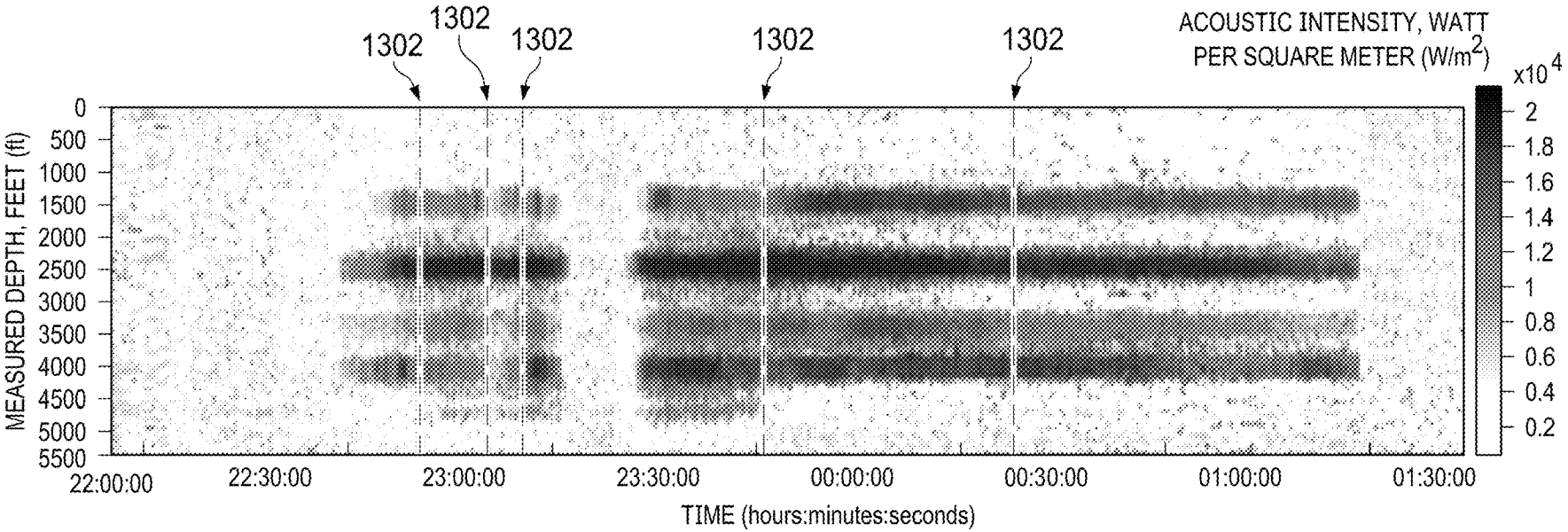

FIGS. 13A and 13B illustrate a power flow of the RLC inversion response compared with averaged DAS acoustic energy intensity, in accordance with examples of the present disclosure. FIG. 13A illustrates a power flow, a power flow with proppant correction, and acoustic energy intensity as a function of time. FIG. 13B illustrates the acoustic energy intensity at various depths. As indicated by quality control (QC) lines 1302, the power flow acting on a fracture calculated from the mass flow RLC model inversion is similar to the average acoustic energy intensity of DAS data. This illustrates that the mass flow RLC model may simulate an actual physical process of slurry flow in the borehole, and the fracture during fracking. The DAS acoustic energy intensity may reveal a rock stress/strain, in which rock stress is exerted by the slurry rate power flow during the fracking process.

Figure 14:
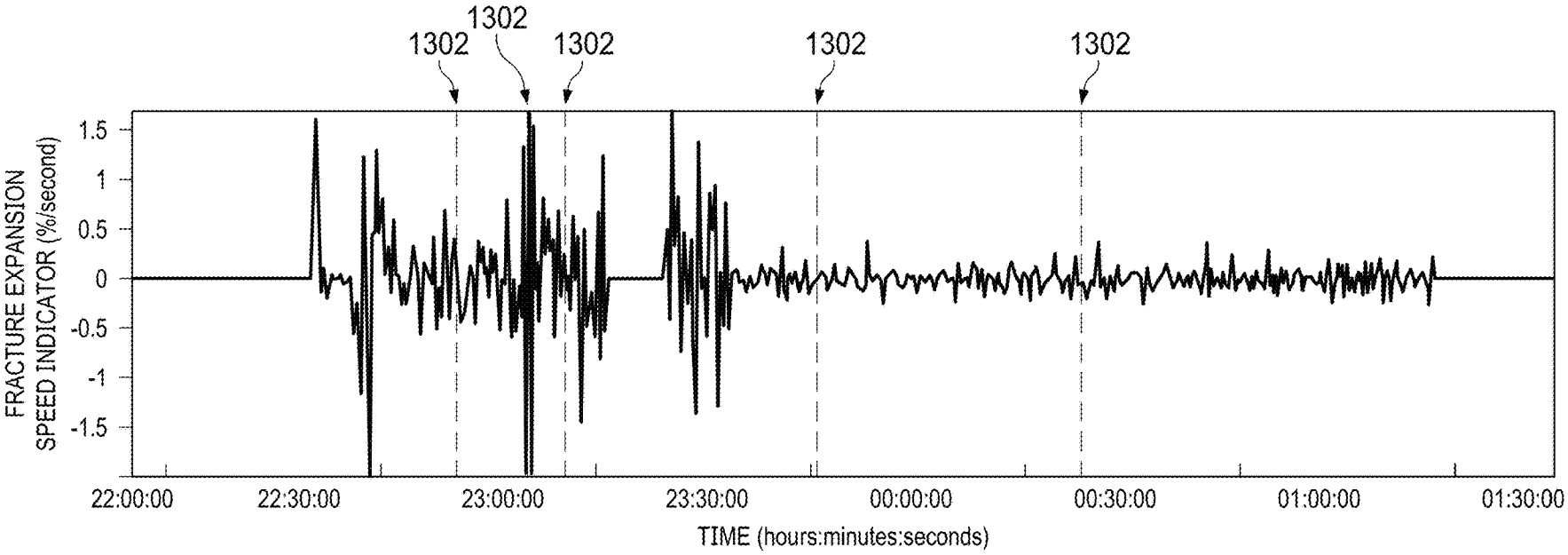
FIG. 14 illustrates a fracture expansion speed indicator, in accordance with examples of the present disclosure.

FIG. 14 illustrates a fracture expansion speed indicator, in accordance with examples of the present disclosure. Positive values indicate that a fracture is open and/or a fracture is propagating; and a negative value indicates a fracture is closing and/or a fracture is shrinking. It should be noted that the value of the fracture expansion indicator is not an exact the fracture expansion speed; rather the value represents an indicative trend. The QC lines 1302 may indicate fracture open and/or close timing events which are interpreted from the DAS data of FIG. 13B. Those fracture open/close timing events may align or correspond with the fracture expansion rate indictor plot peak or trough perfectly.

Figure 15:
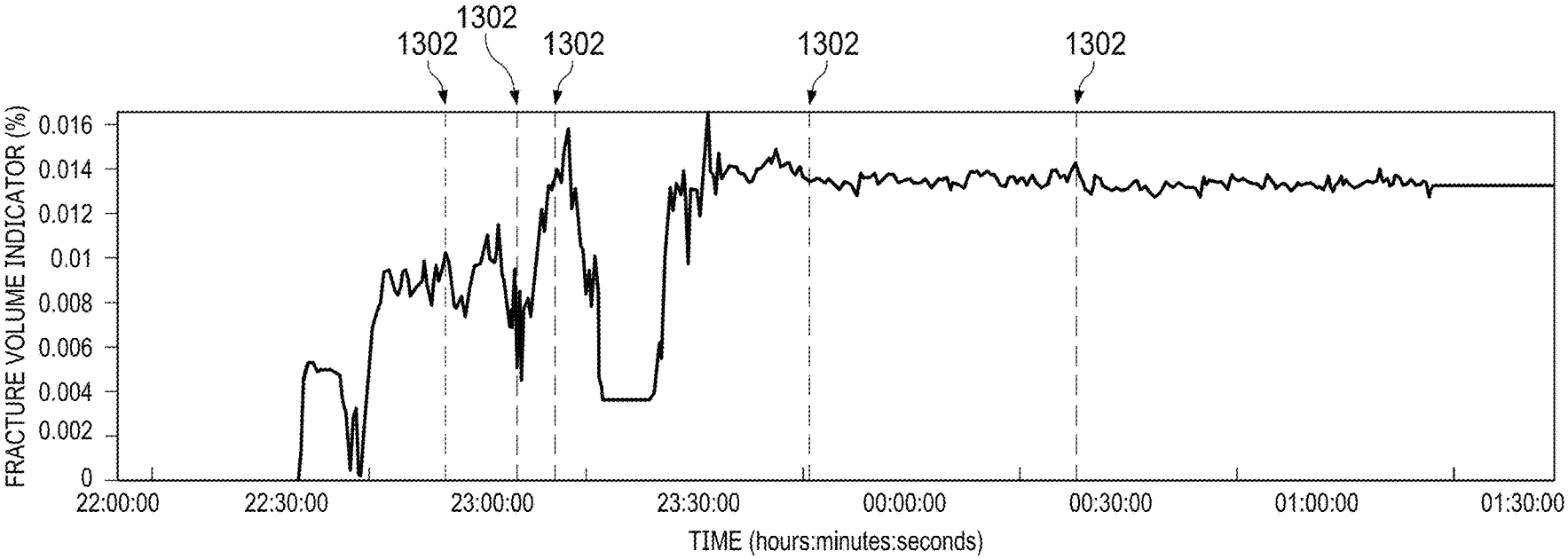
FIG. 15 illustrates a fracture volume indicator varying with time, in accordance with examples of the present disclosure.

FIG. 15 illustrates a fracture volume indicator varying with time, in accordance with examples of the present disclosure. The fracture volume indicator indicates the fracture volume varying with time (hour(s): minute(s): second(s)). The fracture volume indictor may be proportional to a corresponding actual fracture volume value. It should be noted that FIG. 15 illustrates an indicative trend based on the fracture volume indicator. A fracture volume increase indicates a fracture is growing, whereas a decrease indicates the fracture is shrinking. Displayed in real time, the fracture volume indicator may indicate fracture propagation. The QC lines 1302 may indicate that the fracture volume indicator aligns or corresponds with the DAS data of FIG. 13B.

Figure 16:
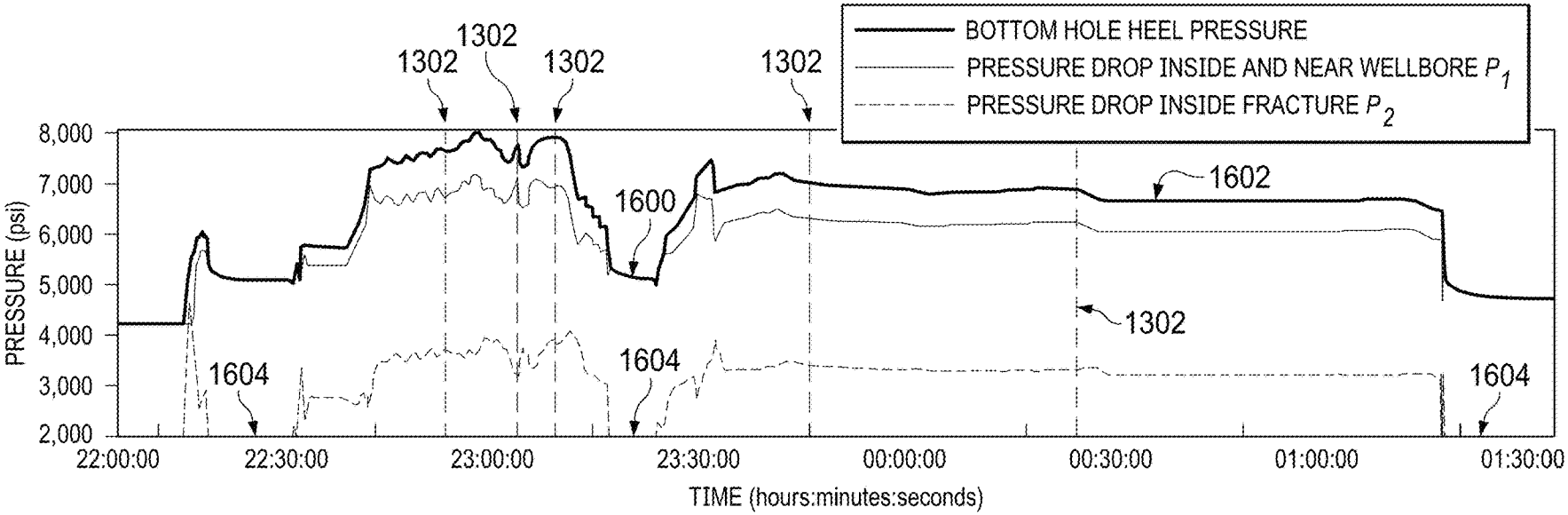
FIG. 16 illustrates a bottom hole heel pressure as a function of time, in accordance with examples of the present disclosure.

FIG. 16 illustrates a bottom hole heel pressure as a function of time, in accordance with examples of the present disclosure. The close pressure P close is indicated by reference number 1600. A pressure $P_1$ is indicated by the reference number 1602. $P_1$ is a pressure drop inside a borehole and near borehole:

$$P_1=P_{fric}P_{close} \tag{17}$$

where $P_{fric}$ is the friction pressure, and $P_{close}$ is the fracture close pressure, as previously noted. $P_1$ is the friction pressure drop that may be transferred to heat energy, and may have no contribution to the fracture propagation. Another component of $P_1$ is the fracture close pressure. This pressure may be a balance pressure in rock pore of the reservoir.

A pressure $P_2$ is indicated by reference numbers 1604. $P_2$ is a pressure drop inside a fracture (without the close pressure). $P_2$ is the net fracture pressure during fracking:

$$P_2=P_{net\ fracture}=P_{fracture}-P_{close}=0 \tag{18}$$

where $P_2$ is zero when a slurry rate is zero. These parameters of Equations 17 and 18 are examples of operational indicators. It should be noted that the trend of $P_2$ is different from a trend of borehole heel pressure indicating that the borehole heel pressure trend has been overwhelmed by the friction pressure change $P_1$. $P_2$ may directly reflect the rock stress which is exerted by a slurry flow. This pressure is the determining force which is used to open the fracture. Through the mass flow RLC model inversion, this pressure may be calculated and separated from the borehole heel pressure. The QC lines 1302 may indicate that the bottom hole heel pressure data aligns or corresponds with the DAS data of FIG. 13B.

Figure 17:
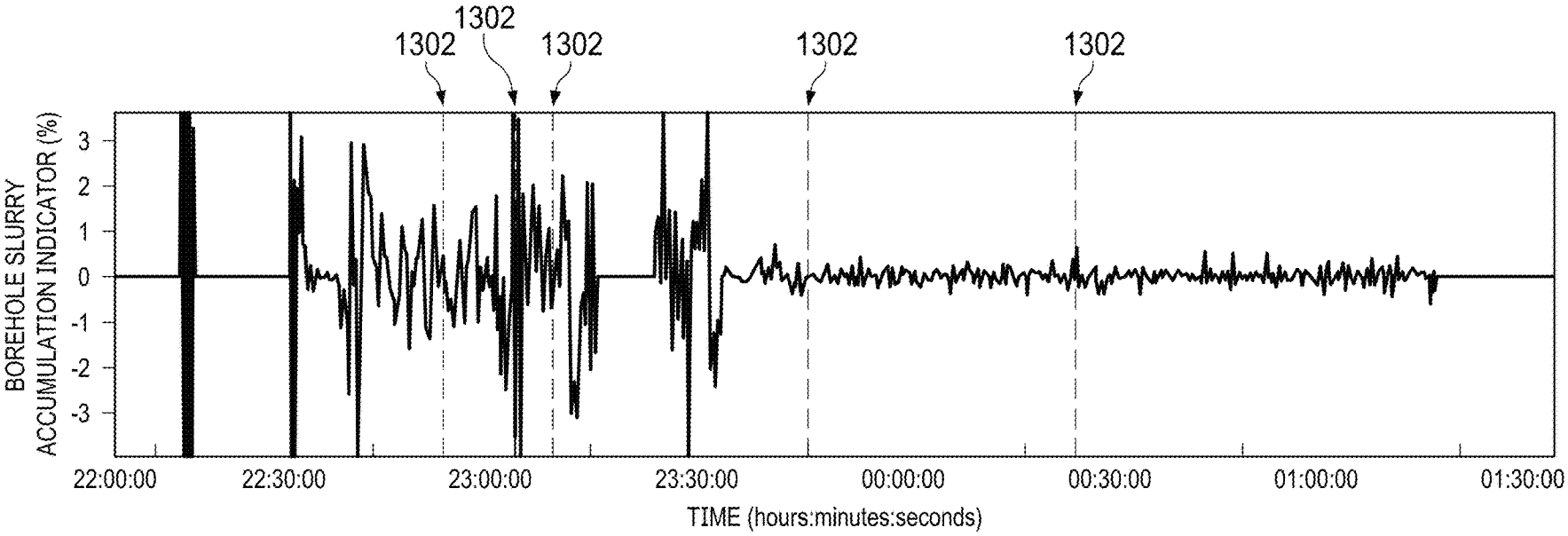
FIG. 17 illustrates a borehole slurry mass accumulation indicator, in accordance with examples of the present disclosure.
Figure 18:
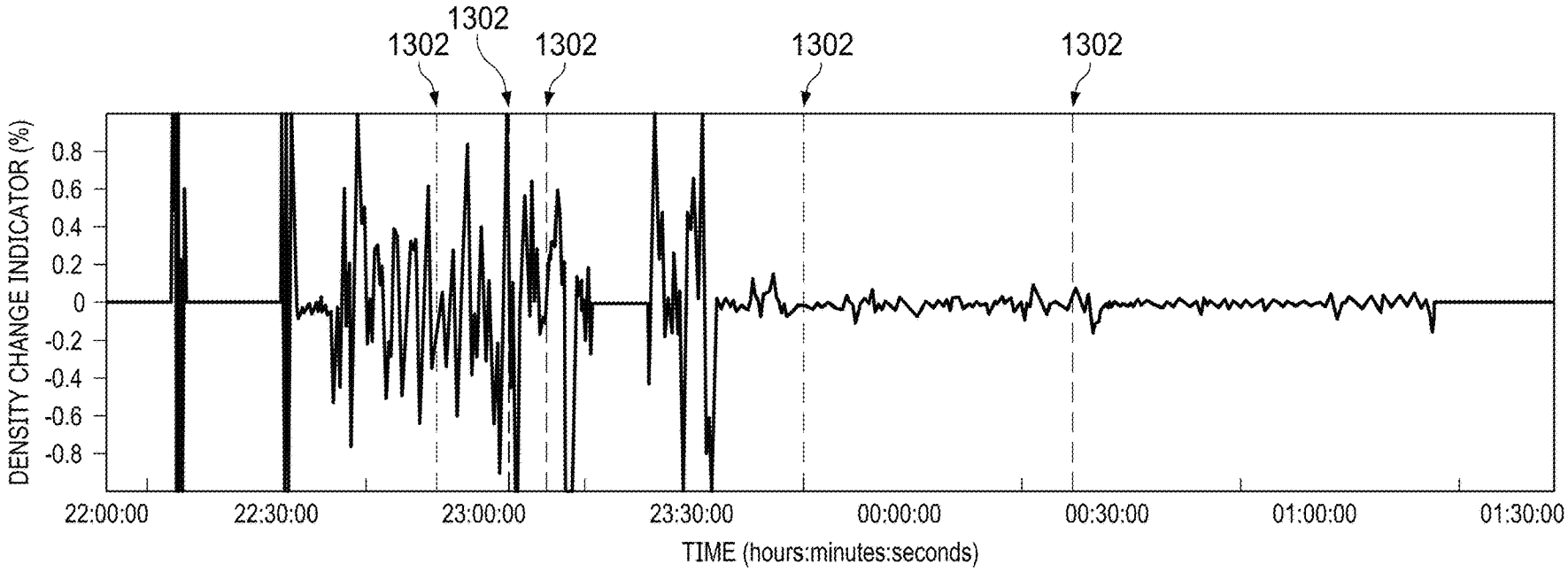
FIG. 18 illustrates a slurry density change indicator, in accordance with examples of the present disclosure.

FIGS. 17 and 18 illustrate borehole slurry mass accumulation and slurry density change indicators, in accordance with examples of the present disclosure. As illustrated on FIG. 17, the QC lines 1302 may indicate that the borehole slurry mass accumulation indicator aligns or corresponds with the DAS data of FIG. 13B. The QC lines 1302 of FIG. 18 may indicate that the density change indicator aligns or corresponds with the DAS data of FIG. 13B. These two operational indicators may be utilized to monitor conditions of the borehole.

Figure 19:
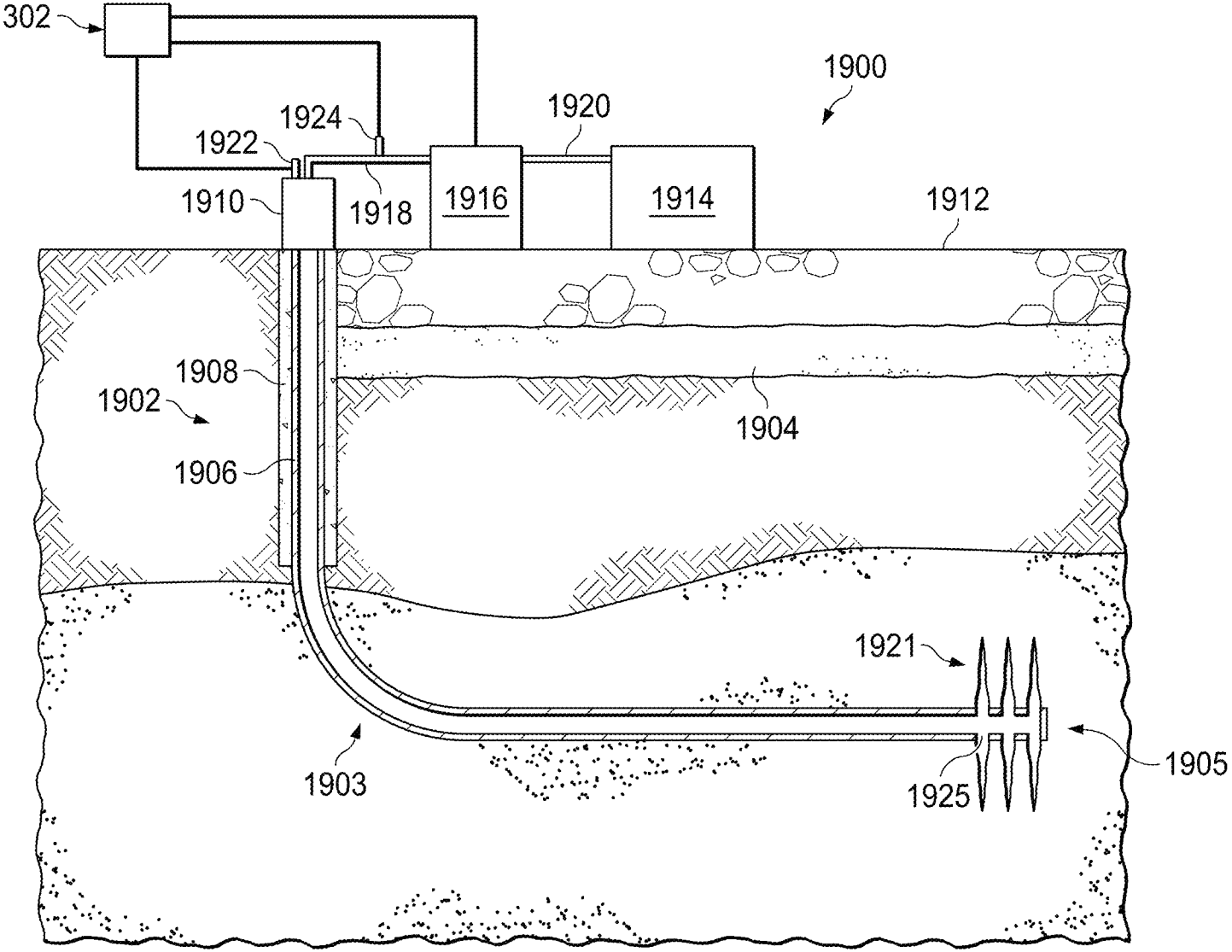
FIG. 19 illustrates a fracking system that may be utilized to control and monitor fracture geometries in real time, in accordance with examples of the present disclosure.

FIG. 19 illustrates a non-limiting example of a fracking system 1900 that may be utilized to control and monitor fracture geometries in real time, in accordance with particular examples of the present disclosure. The fracking system 1900 may be utilized on land operations as well as offshore operations. A wellbore 1902 extends into a subterranean formation 1904. The wellbore 1902 may include a heel 1903 and a toe 1905. Casing 1906 may extend along at least a portion of the wellbore 1902 and may be cemented in place with cement 1908. A wellhead 1910 may be disposed at a surface 1912 above the subterranean formation 1904 and may be in communication with the wellbore 1902. A frac tank 1914 and a fracking pump 1916 may be in fluid communication with the wellhead 1910 and the wellbore 1902 via conduits 1918 and 1920. The conduit 1918 may fluidly couple the wellhead 1910 to the fracking pump 1916. The conduit 1920 may fluidly couple the fracking pump 1916 with the frac tank 1914. The frac tank 1914 may contain a fracturing fluid or slurry for pumping into the wellbore 1902. A pressure gauge or sensor 1922 may be disposed at the wellhead 1910 and may be in fluid communication with the wellbore 1902. A slurry flow sensor 1924 such as a magnetic flow sensor, for example, may be in fluid communication with the conduit 1918 to determine a slurry flow rate. The system controller 302 may be in communication with the pressure sensor 1922, the slurry flow sensor 1924, and the fracking pump 1916.

The fracking pump 1916 may pump the slurry downhole as desired, to create fractures 1921 propagating from the wellbore 1902 via perforations 1925 in the casing. In some examples, the system controller 302 may adjust the slurry flow rate and/or pumping pressure to control and monitor geometries of the fractures 1921, in real time. These adjustments may occur according to the workflows and/or techniques described herein.

Accordingly, the systems and methods of the present disclosure allow for real-time controlling of a fracture dimension to satisfy one or more target objectives, such as, for example: achieving the highest uniformity index, maximizing a ratio of SRV to a pumped slurry volume, or preventing well/depleted production zone interference, when a partial estimate of fracture geometries is available.

Additionally, techniques described herein may be utilized to monitor and evaluate borehole health for wells that include pressure and/or slurry gauges, without additional hardware installation or data acquisition. The systems and methods may include any of the various features disclosed herein, including one or more of the following statements.

Statement 1. A method for real-time controlling of a fracture geometry during a hydraulic fracturing operation, the method comprising: measuring signals representing a condition in a wellbore; inputting the signal into a model for estimating a dimension of a dominant fracture; determining the dimension of the dominant fracture; determining a target dimension for the dominant fracture; and minimizing a difference between the dimension of the dominant fracture and the target dimension in real time, by adjusting at least an injection pressure or flow rate of a hydraulic fracturing fluid into the wellbore.

Statement 2. The method of the statement 1, further comprising inputting the signal into a model comprising at least one resistor, inductor, or capacitor.

Statement 3. The method of the statement 1 or statement 2, further comprising inputting the signal into a poro-elastic inversion.

Statement 4. The method of any preceding statement, further comprising controlling a geometry of the dominant fracture.

Statement 5. The method of any preceding statement, further comprising controlling a geometry of at least the dominant fracture or non-dominant fractures.

Statement 6. The method of any preceding statement, further comprising reducing propagation of the dominant fracture.

Statement 7. The method of any preceding statement, further comprising adjusting at least the injection pressure or the flow rate of the hydraulic fracturing fluid such that geometries of the dominant fracture and non-dominant fractures are of approximately equal size.

Statement 8. The method of any preceding statement further comprising preventing the dominant fracture and non-dominant fractures from extending into another wellbore or a depleted production zone based on the target dimension of the dominant fracture.

Statement 9. A method for real-time monitoring and evaluation of fractures during a hydraulic fracturing operation, the method comprising: selecting slurry rate data and borehole heel pressure data; interpolating and aligning the slurry rate data and the borehole heel pressure data with respect to time; determining a matching filter for slurry rate data and borehole pressure data; inverting parameters of a model that is based on at least resistance, inductance, and capacitance, wherein the parameters are based on the matching filter and a response of the model; obtaining operational indicators from an inversion of the parameters; and controlling a slurry flow rate into a wellbore based on the operational indicators for the hydraulic fracturing operation.

Statement 10. The method of the statement 9, further comprising selecting a local window.

Statement 11. The method of the statement 9 or statement 10, further comprising truncating the slurry rate data and the borehole heel pressure data in the local window.

Statement 12. The method of the statement 11, further comprising applying a filter to the slurry rate data and the borehole heel pressure data to obtain the matching filter.

Statement 13. A hydraulic fracturing system comprising: a frac tank; a pump in fluid communication with the frac tank; a sensor configured to measure a property in a wellbore; and a system controller in communication with the pump and the sensor, the system controller configured to: receive signals from the sensor and estimate a dimension of a dominant fracture propagating from the wellbore; invert parameters from a model based on resistance, inductance, and capacitance, wherein the signals are inputs for the model; and control the pump based on the estimate of the dimension of the dominant fracture or operational indicators.

Statement 14. The system of the statement 13, wherein the system controller is further configured to input the signals into a model comprising at least one resistor, inductor, or capacitor.

Statement 15. The system of the statement 13 or statement 14, wherein the system controller is further configured to input the signals into a poro-elastic inversion.

Statement 16. The system of any one of the statements 13 to 15, wherein the system controller is further configured to: select slurry rate data and borehole heel pressure data; and interpolate and align the slurry rate data and the borehole heel pressure data with respect to time.

Statement 17. The system of the statement 16, wherein the system controller is further configured to: select a local window of the slurry rate data and the borehole pressure data for processing.

Statement 18. The system of the statement 17, wherein the system controller is further configured to: determine a matching filter between the slurry rate data and the borehole pressure data.

Statement 19. The system of the statement 18, wherein the system controller is further configured to: invert parameters from a model based on the matching filter and a response of the model; and obtain operational indicators from inverted parameters, the operational indicators indicative of a hydraulic fracturing operation.

Statement 20. The system of the statement 19, wherein the system controller is further configured to control the pump based on the operational indicators.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A hydraulic fracturing system comprising:
a frac tank;
a pump in fluid communication with the frac tank;
a sensor configured to measure a property in a wellbore; and
a system controller in communication with the pump and the sensor, the system controller configured to:
receive signals from the sensor and estimate a dimension of a dominant fracture propagating from the wellbore;
invert parameters, to obtain inverted parameters, from a model based on resistance, inductance, and capacitance, wherein the signals are inputs for the model;
control the pump based on the estimate of the dimension of the dominant fracture or operational indicators;
select slurry rate data and borehole heel pressure data; and
interpolate and align the slurry rate data and the borehole heel pressure data with respect to time.

2. The system of claim 1, wherein the system controller is further configured to input the signals into the model comprising at least one resistor, inductor, or capacitor.

3. The system of claim 1, wherein the system controller is further configured to input the signals into a poro-elastic inversion.

4. The system of claim 1, wherein the system controller is further configured to select a local window for the slurry rate data and the borehole heel pressure data for processing.

5. The system of claim 4, wherein the system controller is further configured to determine a matching filter between the slurry rate data and the borehole heel pressure data.

6. The system of claim 5, wherein the system controller is further configured to invert the parameters from the model based on the matching filter and a response of the model.

7. The system of claim 6, wherein the system controller is further configured to obtain the operational indicators from the inverted parameters.

8. The system of claim 7, wherein the operational indicators are indicative of a hydraulic fracturing operation.

9. The system of claim 8, wherein the system controller is further configured to control the pump based on the operational indicators.

10. The system of claim 1, wherein the system controller is further configured to select a local window for the slurry rate data.

11. The system of claim 1, wherein the system controller is further configured to select a local window for the borehole heel pressure data.

12. The system of claim 1, wherein the system controller is further configured to select a local window.

13. A hydraulic fracturing system comprising:
a frac tank;
a pump in fluid communication with the frac tank;
a sensor configured to measure a property in a wellbore; and
a system controller in communication with the pump and the sensor, the system controller configured to:
receive signals from the sensor and estimate a dimension of a dominant fracture propagating from the wellbore;
invert parameters from a model based on resistance, inductance, and capacitance, wherein the signals are inputs for the model;
control the pump based on the estimate of the dimension of the dominant fracture or operational indicators; and
input the signals into the model comprising a first resistor, a second resistor, an inductor, and a capacitor, wherein the first resistor represents a friction pressure and close pressure for the dominant fracture.

14. The system of claim 13, wherein the second resistor represents a net fracture pressure.

15. The system of claim 14, wherein the model further comprises a voltage and a current.

16. The system of claim 15, wherein the voltage represents a measured pressure.

17. The system of claim 16, wherein the current represents a slurry flow rate.

18. The system of claim 13, wherein the system controller is further configured to obtain the operational indicators from the inverted parameters.

19. The system of claim 18, wherein the operational indicators are indicative of a hydraulic fracturing operation.

20. The system of claim 19, wherein the system controller is further configured to control the pump based on the operational indicators.

* * * * *